US011369216B2

(12) United States Patent
Fleega

(10) Patent No.: US 11,369,216 B2
(45) Date of Patent: Jun. 28, 2022

(54) HOLDER FOR PERSONAL ITEMS

(71) Applicant: Ihab Fleega, Ulm (DE)

(72) Inventor: Ihab Fleega, Ulm (DE)

( * ) Notice: Subject to any disclaimer, the term of this patent is extended or adjusted under 35 U.S.C. 154(b) by 0 days.

(21) Appl. No.: 16/766,745

(22) Filed: May 25, 2020

(65) Prior Publication Data

US 2020/0323364 A1 Oct. 15, 2020

(51) Int. Cl.
*A47F 5/08* (2006.01)
*A47F 5/00* (2006.01)

(52) U.S. Cl.
CPC ..... *A47F 5/0823* (2013.01); *A47F 5/005* (2013.01)

(58) Field of Classification Search
CPC ..... A47F 5/0823; A47F 5/005; A47F 5/0815; A47K 10/14; Y10T 403/55; Y10T 403/553; Y10T 403/559; Y10T 403/61; Y10T 403/7094
USPC .... 211/85.13, 85.5, 85.9, 44, 57.1, 59.1, 61, 211/66, 75, 70.6, 69.8, 120; 248/220.31, 248/220.41, 220.42, 220.43, 309.1, 682; 403/292, 294, 298, 331, 381
See application file for complete search history.

(56) References Cited

U.S. PATENT DOCUMENTS 1,485,092 A * 2/1924 Rauchutfrank ..... A47L 13/512 24/526
2,051,408 A * 8/1936 Karst ..... A47F 5/0876 211/65
2,528,859 A * 11/1950 Chaika ..... A47G 25/746 211/100
3,154,281 A * 10/1964 Charles ..... F16B 21/06 248/201
3,255,987 A * 6/1966 Gatch ..... F16B 21/02 248/220.31
3,392,949 A * 7/1968 Meyer, Jr. ..... A47K 1/08 248/220.42
3,409,141 A * 11/1968 Cunningham, Jr. ... B65H 49/38 211/85.5
3,880,390 A * 4/1975 Niven ..... A47F 5/0815 248/220.43
3,944,176 A * 3/1976 Danko ..... H04Q 1/142 248/68.1
4,262,799 A * 4/1981 Perrett ..... A61L 2/26 206/363

(Continued)

FOREIGN PATENT DOCUMENTS

GB 2496600 A * 5/2013 ..... A47F 5/0823

*Primary Examiner* — Jennifer E. Novosad
(74) *Attorney, Agent, or Firm* — Michael D. Eisenberg

(57) ABSTRACT

Items are clamped between damping sheaths (11, 51) which are each secured around a carrier (12, 52), wherein a plurality of composite bodies (5, 10) are oriented with respect to one another such that their carriers (12, 52) are arranged in parallel and are held, with their end protruding from the sheath (11, 51), in holes (21) of a plate (2). Preferably, plates (2) can be locked onto one another to form a plate layer (20), or the composite bodies (5, 10) are components connected to one another by cohesive bonding. Plates (2) and carriers (12, 52) of composite bodies (5, 10) may shaped such that the carriers (12, 52) fit with one end into the plates (2) and with this end can be locked onto the plates. Preferably, connection bridges (3, 4) and plates (2) are shaped such that the plates (2) can be locked onto the connection webs (3, 4) to form a plate layer (20).

20 Claims, 10 Drawing Sheets

(56) References Cited

U.S. PATENT DOCUMENTS 4,304,382 A * 12/1981 Jelen ..... B25H 3/04 211/89.01
4,325,484 A * 4/1982 Berry ..... A01K 97/08 211/66
4,341,314 A * 7/1982 Feuerstein ..... A47B 57/581 211/184
4,749,160 A * 6/1988 Shih ..... B25H 3/04 211/66
4,798,292 A * 1/1989 Hauze ..... A61L 2/26 206/439
5,203,135 A * 4/1993 Bastian ..... F16B 7/0413 403/292
5,346,075 A * 9/1994 Nichols ..... A61B 50/20 211/60.1
5,441,709 A * 8/1995 Berry, Jr. ..... A61L 2/06 422/297
5,681,539 A * 10/1997 Riley ..... A61L 2/26 206/370
5,827,487 A * 10/1998 Holmes ..... A61L 2/26 422/297
6,129,220 A * 10/2000 Decossas ..... A47F 5/0823 211/13.1
6,331,280 B1 * 12/2001 Wood ..... A61L 2/26 206/268
6,382,575 B1 * 5/2002 Frush ..... A61L 2/26 211/85.13
6,412,735 B1 * 7/2002 Mathieu ..... A47K 1/09 211/66
6,436,357 B1 * 8/2002 Frieze ..... A61L 2/26 206/263
6,763,956 B2 * 7/2004 Woods ..... A47B 73/00 211/74
7,601,312 B2 * 10/2009 Riley ..... A61B 50/33 248/309.1
7,722,837 B2 * 5/2010 Riley ..... A61B 50/20 422/300
7,861,860 B2 * 1/2011 Bettenhausen ..... A61B 50/34 206/370
9,149,115 B2 * 10/2015 Kasza ..... A47F 5/0838
9,149,730 B1 * 10/2015 Hauser ..... A63H 3/50
9,975,237 B2 * 5/2018 Norris ..... B25H 3/06
10,058,230 B2 * 8/2018 Gobi ..... A47L 15/505
10,405,676 B1 * 9/2019 Underwood ..... F16B 45/00
10,835,339 B2 * 11/2020 Krensky ..... A61B 50/20
2001/0002521 A1 * 6/2001 Maniezzo ..... A47F 5/0823 52/27
2003/0080079 A1 * 5/2003 Wu ..... F16B 2/16 211/89.01
2003/0189017 A1 * 10/2003 Boron ..... G11B 33/0461 211/40
2007/0009408 A1 * 1/2007 Riley ..... A61B 50/33 422/300
2007/0251904 A1 * 11/2007 Winig ..... A47B 96/06 211/106.01
2007/0290107 A1 * 12/2007 Lang ..... A47F 5/0815 248/220.31
2008/0000861 A1 * 1/2008 Muellerleile ..... A47B 96/06 211/94.01
2009/0039742 A1 * 2/2009 Ripley, Jr. ..... A47F 3/004 312/114
2009/0146032 A1 * 6/2009 Bettenhausen ..... A61B 50/30 248/220.31
2009/0199372 A1 * 8/2009 Anderson ..... F16B 15/06 24/458
2009/0218303 A1 * 9/2009 Winnard ..... B25H 3/003 211/70.6
2010/0051769 A1 * 3/2010 Tyson ..... A47F 5/0807 248/220.31
2010/0294734 A1 * 11/2010 Taike ..... B01L 9/06 211/85.13
2011/0073730 A1 * 3/2011 Kitchen ..... A47F 5/0815 248/220.31
2012/0217360 A1 * 8/2012 Fanning, Jr. ..... G09F 5/042 248/220.31
2012/0241397 A1 * 9/2012 Strollo ..... A47B 81/00 211/71.01
2016/0029790 A1 * 2/2016 Carpenter ..... A47B 47/00 211/75
2016/0061354 A1 * 3/2016 Abby ..... B65H 75/446 211/85.5
2016/0331131 A1 * 11/2016 Ghaeni ..... A47B 73/006
2020/0205586 A1 * 7/2020 Arradondo ..... A47F 5/0006
2020/0323364 A1 * 10/2020 Fleega ..... A47F 7/02

* cited by examiner

HOLDER FOR PERSONAL ITEMS

The present invention relates to methods for holding objects, which may be clamped between damping or elastic sleeves or caps or may be suspended thereon, a holding system suitable for this purpose, which is modular in particular, modules for this purpose and mats constructed thereby, methods for producing a holding system, and the use of composite bodies each containing a carrier and a damping or elastic sleeve or cap fastened at or on the carrier.

To hold objects, there are storage surfaces, for example, tables, shelves, or floors, and also holding mats, in particular egg cartons and sound insulation derived therefrom, wardrobes, gratings, and hooks.

Structured foam mats from Feldherr enable a slip-proof seating of objects carried in cases. In one embodiment according to www.feldherr.com/de/hs040spl-half-figure-foam-tray-with-37-round-cut-outs-self-adhesive-1-6-inch-40-mm-vallejo-paints.html, plastic bottles having screw caps are held in holes between two perforated foam mats.

Lutz Möller uses slotted foam mats as ammunition holders. At Waffen Braun, rifles placed on a table are provided with foam and held on boards fastened on A wall.

There are also washing machine inserts, in particular for bottles or test tube holders in which the bottles or test tubes are held on rods of a framework.

DE 199 08 245 discloses a plug system for presenting jewelry, in which the jewelry is fastened using a holding body pluggable into a base body.

For suspending objects, DE 20 2005 002 740 discloses carriers which are fastened in a panel. These systems are limited to special applications, in particular for tidying or organizing identical objects.

The object of the present invention is to provide a holding system for greatly varying objects, in particular also for those for which no standard place is provided, for example, charger, remote control, mobile telephone, spectacles, laptop, ballpoint pen, wallet, shampoo, hairdryer, and toys, which is adaptable for arbitrary applications, in particular horizontally, vertically, and linear combinations thereof are applicable and is easy to dimension, fasten, and shape in vehicles, living spaces, offices, and bathrooms. Various objects are to be able to be deposited and removed visibly, securely, and easily, instead of being held in a concealed or obstructive manner.

To achieve the object, multifunctional composite bodies and plates are provided, which are lockable on one another in a friction-locked or formfitting manner. The achievement of the object is performed by the features of the independent claims. The dependent claims contain features of inventive refinements.

According to the invention, an end of a rod or rigid carrier protruding from a sleeve is part of a fitting, in particular a quick-action fitting. For this purpose, according to the invention bodies made of composite material are provided, which comprise carriers, in particular injection-molded rods and a damping sleeve fastened around it, in particular a foam sleeve, the carriers of which protrude with one end out of the sleeve to lock the bodies in a base, for example, plate, using this end.

To hold objects, in particular greatly differing objects, which may be clamped between damping or elastic sleeves or caps and to hold objects which may be suspended thereon, according to the invention, composite bodies are provided, in particular rollers, each containing a carrier, in particular a rod, and a damping or elastic sleeve or cap fastened at or on the carrier, in particular made of foam. The composite bodies (5) are aligned for this purpose in relation to one another so that the rod or rigid carriers (52) thereof are arranged in parallel each having the end thereof protruding out of the sleeve or cap or sheath (51) held in holes (21), which are prepared for locking, of a plate (2) and align the damping or elastic sleeves or caps or sheaths (51). In particular, the composite bodies and plates are lockable on one another in a friction-locked or formfitting manner. This enables a two-dimensional arrangement of composite bodies aligned in parallel with the advantage of manifold options for providing objects.

On the method side, multiple composite bodies, in particular rollers, are fixed in parallel to one another according to the invention. For this purpose, the carriers thereof, in particular rods, are aligned with the respective end thereof protruding out of the sleeve or cap in holes of a receptacle structure, preferably plate, and locked at the holes in a friction-locked or formfitting manner. The carrier parts, which are plugged into the sleeve or cap and preferably extend perpendicularly out of the plate after the locking, thus fix the damping or elastic sleeves or caps, which are in particular made of foam.

This enables various objects to be held at arbitrary locations, in particular objects which were previously held on storage surfaces such as tables or floors. This furthermore enables the components to be produced as modules from 2 materials, namely a carrier material, in particular injection molding, and a damping material, in particular soft foam. An adhesive for the material bond to form the composite is preferably used as a third material.

Modules simplify an individual formation of the holders to form mats. For this purpose, the plates are preferably locked on one another in a formfitting manner using slots extending in the edges thereof.

A formation according to the subject matter of the solution is performed using a receptacle base, which comprises holes which are formed for a friction lock or form fit with composite bodies, which comprise a damping or elastic sleeve or cap and each comprise a carrier mechanically lockable with the base, using which the composite bodies, in particular rollers, are mechanically fixed by plugging into the base. The carrier and the sleeve or cap are fixed with one another by a material bond to form a composite material so that the carrier protrudes out of the sleeve with its end formed for the locking in the plate.

In particular, the solution is performed using plates which are preferably locked on one another in a formfitting manner to form a plate layer and comprise holes, which are designed for a friction lock or form fit with composite bodies, which comprise a damping or elastic sleeve or cap and a carrier mechanically lockable with the plate, using which the composite bodies, in particular rollers, are mechanically fixed by plugging into the plates or the plate layer. This enables the holders to be embodied as modules and thus to be individually formed particularly simply. The modules preferably contain locking units to lock the plates on one another in a formfitting manner. In particular, the plates are locked on one another in a formfitting manner using slots extending in guides in the narrow sides thereof. This enables an easily variable arrangement of the modules.

The receptacle structure or plates preferably have holes spaced apart regularly from one another for holding the composite bodies, in particular rollers. The holes are spaced apart so that the composite bodies plugged therein do not touch, in particular the composite bodies are spaced apart by more than one-tenth of their radii and less than 5 tenths, in particular less than 3 tenths. The holes and the ends protruding from the sleeves or caps are adapted to one another for detachable fastening, in particular as a screw fitting. The holding carrier end simplifies the usage of the sleeve for holding objects.

Holes and carrier ends adapted to one another optimize the detachable fastening. In particular, the damping sleeves thereof form a surface, into which various objects are pluggable. The composite bodies form a relatively broad holding layer, which effectuates adhesion by damping in particular due to its lesser density in relation to the plate layer and effectuates holding by relatively rigid carriers, preferably rods, protruding from the plate layer. In this holding layer, the carriers, in particular the threaded rods screwed into the plates or clicked-in rods, provide the damping or elastic sleeves or caps with a relatively more rigid structure, which significantly assists the holding of the objects to be held.

The composite bodies are preferably locked via clicking or tightening of the screw connection. The carriers protruding from the fastening end into the sleeve enable suspension of objects and stabilize the fixing function of the damping holding layer. For example, axial composite bodies, in particular axially-symmetrical bodies protruding perpendicularly thereto, preferably rollers, cones, or bulbous bodies made of a rod and an elastic material fastened on it or over it, for example, foam sleeve or air cushion sleeve, are held in the plates, preferably at regular intervals, for example, by means of threads on the rods and regularly spaced-apart counter threads thereto in the plates.

The locking units, in particular slots extending in narrow sides, ensure the stability of the formation, in particular by form fit. The form fit is provided using 2 slots perpendicular to one another which connect the plates. Such plates arranged equatorially in relation to one another form a layer, in which plates and connecting webs arranged in parallel to one another are displaceable in relation to one another in a laterally interlocking manner. Connecting webs inserted perpendicularly to these connecting webs, in particular displaceable tongues engaging laterally in groups of the plates, lock the plates on one another. If multiple plates are fastened laterally on one another, in particular via intermediate webs equatorially in relation to one another, to form a plane, the plates may be displaced in arbitrary rows in relation to one another, if the intermediate webs do not hold the plates together via the corners thereof. Accordingly, a form fit is produced by blocking using intermediate webs connecting via corners.

Modules, containing plates, units for locking multiple plates into a plate layer, and composite bodies facilitate the construction of individually formable holders, in particular mats for holding objects, according to the invention. For this purpose, the plates having the locking units are preferably assembled to form a planar plate layer and the composite bodies are screwed or clicked axially into the structure. The composite bodies, in particular rollers, can be locked so that they do not loosen during the provided use, in particular upon the removal of held objects. According to the invention, a mat is thus also provided, containing a plate layer, in particular plane, and a damping layer fastened in the plate layer for suspending and accommodating objects. This holding layer results from composite bodies plugged into the plate layer, in particular rollers, which each have an end that can be held in the plate layer, in particular a rod, and a damping or elastic sleeve or cap fastened on it or over it, in particular made of foam. The composite bodies are locked in the plate layer in that the composite bodies, which are screwed or clicked into the plate layer, are preferably rollers which can be screwed in or clicked and are each made of a rod fastened in foam. In particular room dividers, doors, and side walls of cabinets are usable as mats according to the invention.

A novel type of storage is thus provided, which reclaims surfaces, on which typically deposited or non-tidied objects are located. Thus, that which has previously laid around untidied in rooms, garages, workshops, offices, and bathrooms will in future be plugged, suspended, or clamped in the holding or organizing system according to the invention. The plugged, suspended, or clamped objects are then held or tidied in a well visible manner.

The production of a holding system is preferably performed by means of injection molding, in that connecting webs and plates are molded so that the plates are lockable on one another using connecting webs to form a plate layer, or elastic sleeves are fastened on rods and the rods and plates are molded so that the rods can be screwed or locked into the plates.

Injection molding is suitable for the mass production of the plates and connecting webs. Plastics, in particular hard plastics based on PVC, PE, PP, ABS, and PS, have proven to be suitable materials for the plates.

The composite bodies according to the invention may be provided for various applications, i.e., not only for holding further objects.

The locking is performed mechanically, in particular by friction locking, for example, tightening of a screw having stop until the stop presses against the edge around the screw hole, or via form fit, in particular bayonet fitting or click fitting. The locking is preferably a quick-action fitting, in particular a screw fitting.

Alternatively, the locking is performed by formfitting, in particular bayonet fitting or click fitting.

The locking is a mechanical system for fixing and loosening the composite material having a hole, in particular a threaded hole of a base on which the composite material is lockable.

The composite material, in contrast, is a materially-bonded connection, i.e., it is not separable into its components without destruction, in particular made of bodies flatly connected to one another, for example, bodies connected to one another chemically or over the full surface. The rollers are multifunctional as a materially-bonded connection, which may be connected in a friction-locked or formfitting manner at a fastening hole of a base.

To produce a composite material, profiles are arranged in a materially-bonded manner. For this purpose, a damping sleeve is attached to a carrier, in particular adhesively bonded or welded, so that the carrier is in the region which is provided for locking, protrudes out of the sleeve, and the carrier is formed having the part protruding out of the sleeve such that it can be guided in a hole of a plate, in or at which it is lockable in a friction-locked or formfitting manner.

The multifunction composite material according to the invention is a tool or semi-finished product for various applications, in particular for cleaners, preferably having a rod in which it is locked, shock absorber, preferably a base lockable on a utensil, or curler, preferably having a base in which it is lockable.

The composite material is provided for holding, is easy to keep ready, and enables the holding of objects. For this purpose, it is designed for locking in a base or at a fastening hole, in particular for a quick-action fitting, for example, a screw fitting, bayonet fitting, or click fitting.

The carrier end protruding out of the sleeve preferably comprises a thread or is formed as part of a click fitting or bayonet fitting. In particular, the sleeve is a foam sleeve. Rotatable fittings for paint rollers or printer rollers are available by means of click fitting.

The air contained in the composite body provides it with a low density in relation to its circumference, in particular less than 0.9 g/cm, preferably less than 0.7 g/cm$^3$, which makes it suitable for logistics and/or transportation, in particular as a shock absorber. For this purpose, the rod is preferably formed as a tube.

Carriers formed as tubes enable the application of a liquid conducted through the tube and also correspondingly simple cleaning of the composite material. This enables accurately metered treatment of hair with color, tinting, bleach, care product, or shampoo. Cleaner sets having various sleeve shapes and sleeve sizes, and also various tube or rod extensions and angles similar to a toolbox are provided for professional cleaning. The use for application of liquids or for suctioning at inaccessible positions is significantly facilitated.

The foam coating preferably adheres in a chemically fastened manner on the rod. In a proven manner, it adheres using adhesive, in particular plastic adhesive on the rod. Coatings made of soft foam, for example, polyester, are particularly suitable. A coating, for example, a textile coating, optionally adheres mechanically to the foam roller or is chemically fastened thereon, in particular adhesively bonded.

Because the sleeve can also be welded on the carrier, it only requires 2 starting materials, since all parts except for the foam coating are producible in injection molding. The rods are preferably cut to size from tubes or bars. Metal bars or plastic bars are already usable from 3 mm diameter for 1 to 3 cm thick rollers. In general, a ratio of roller diameter to rod diameter of 3-10 has proven itself. For example, metal or plastic tubes or wooden rods available as piece goods having a diameter of 5-50 mm are cut to size to a length of 5-20 cm and a thread is cut on one end.

The foam coating is preferably adhesively bonded on the rod, while the other parts are formed as a building block system for detachable fastening on one another. This enables the removal of rollers, consisting of the rods and the foam coating, at any time to provide space for larger objects. On the other hand, the foam coatings cannot be stripped off easily, but rather provide continuous adhesion for objects to be tidied and the rods therein provide the required stability. The plates can be reformed at any time into new planar formations, so that in this regard individual designs which are fully flexible to the desired unit or its change are enabled. The foam coatings may be covered using a textile coating, for example, to protect the spectacles or the display screen of the mobile telephone or tablet or to have a more visually appealing effect. The plates, preferably threaded plates, enable simple tongue and groove connections on one another as polygons, in particular rectangles, preferably squares. In particular using intermediate strips, not only a displacement of rows and columns is enabled, but rather also a displacement of individual outer plates. Plates having rounded corners have proven themselves. The roundings reduce the attack potential and avoid possible injuries accompanying this at the corners, tangling of fibers of objects possibly to be tidied, and damage to the plates.

The polygons can be assembled into individual patterns, for example, into letters or names. Different colored polygons enable greatly varying creative compositions and artistic individual designs.

The plates are preferably held on one another using connecting webs or bridges, in particular using connecting webs displaceable on or in the plates. For this purpose, 1-100 cm, in particular 5-20 cm long, and 2-200 mm, in particular 4-20 mm thick plates are suitable.

In one preferred embodiment, a modular holding or organizing system made of mechanically detachably fastened plates and rollers is provided, which comprise a foam sleeve and are detachably held mechanically in particular by means of threads in a plate, wherein multiple plates can be held on one another in a mechanically detachable manner to form larger planar formations. By removing or adding rollers, the organizing system may be adapted at any time for the objects presently to be held or tidied.

The basis for the rollers of the modular holding or organizing system are plastic plates lockable on one another to form a plane, which offer a holding system for rollers and can be assembled to form a flat pattern. The objects to be tidied are held using rollers screwed or clicked perpendicularly into the two-dimensional pattern. The rollers are fastening rods coated with foam, in particular threaded rods or rods having click system. In general, a ratio of roller diameter to rod diameter of 3-10 (3 to 1 to 10 to 1) has proven itself.

For example, metal or plastic tubes or wooden rods available as piece goods having a diameter of 0.5-100 mm, in particular 5-50 mm, are cut to size to a length of 0.5-50 cm, in particular 5-20 cm and a thread is cut at one end.

The part of the rod not covered by foam, which is preferably 10 to 50% of the rod length, is provided for holding in the plate. In particular, a thread is cut in this region.

Rollers made of 5 mm to 30 mm long sleeves or caps having a diameter of 2 mm to 30 mm having 5-20 mm long injection molded, glass fiber, or metal pins, the diameter of which is 0.5-1 mm, are suitable for tidying finely crafted items, for example, jewelry, diamonds, and precious stones. A textile coating on the plate protects the finely crafted items from hard impacts thereon in the case of vertically fastened rollers in horizontally arranged plates.

According to the invention, a modularly assembled mat made of plates and rollers plugged therein having foam sleeve is provided using the modules, in which the rollers are fastened in the plates, so that the rollers are screwed or clicked into the plates, wherein multiple plates are can be detachably fastened with one another to form planar formations. The plates are provided for vertical and horizontal fastening on walls, ceilings, floors, and doors of rooms and items of furniture. There are manifold uses of the mat, for example, as wall furniture, counter which can be set up, room divider, or mirror holder.

The holding or organizing system according to the invention is suitable for free walls of many rooms and items of furniture, to hold or tidy most items, which otherwise lie around, for example, in the bedroom over the nightstand, the bureau, etc., in the bathroom around the mirror, around the sink, over and on the bathtub, etc., in the living room over the sofa for the beverages, remote control, and snacks, etc., in the office for cables and various office articles, in the garage for tools.

The holding or organizing system can be created and changed according to personal taste, even by children as a game as well. It is variable in size by the selected quantity of modules and/or plates, variable in color and shape of the composition, for example, as a geometric shape, letters, or images. It is therefore not only useful but rather also usable in a decorative and personal manner.

The space of the surfaces which laid idle due to non-tidied objects is reclaimed according to the invention.

In an embodiment for vehicles, dashboards or consoles are provided as a plate layer or plate. Rollers matching thereto are provided for locking in holes in the dashboard or the console. For this purpose, the rollers comprise carriers, which are lockable in the holes, in particular can be screwed or clicked. Damping sleeves fastened on the carriers are used for holding accessories, personal objects, and provisions. For this purpose, the utensils to be held are clamped between the rollers. For better view of a navigation device or smart phone, the rollers obstructing the view of the display screen are detached from the dashboard or not fastened therein to begin with.

The invention is illustrated hereafter with the aid of examples with reference to figures.

Figure 7:
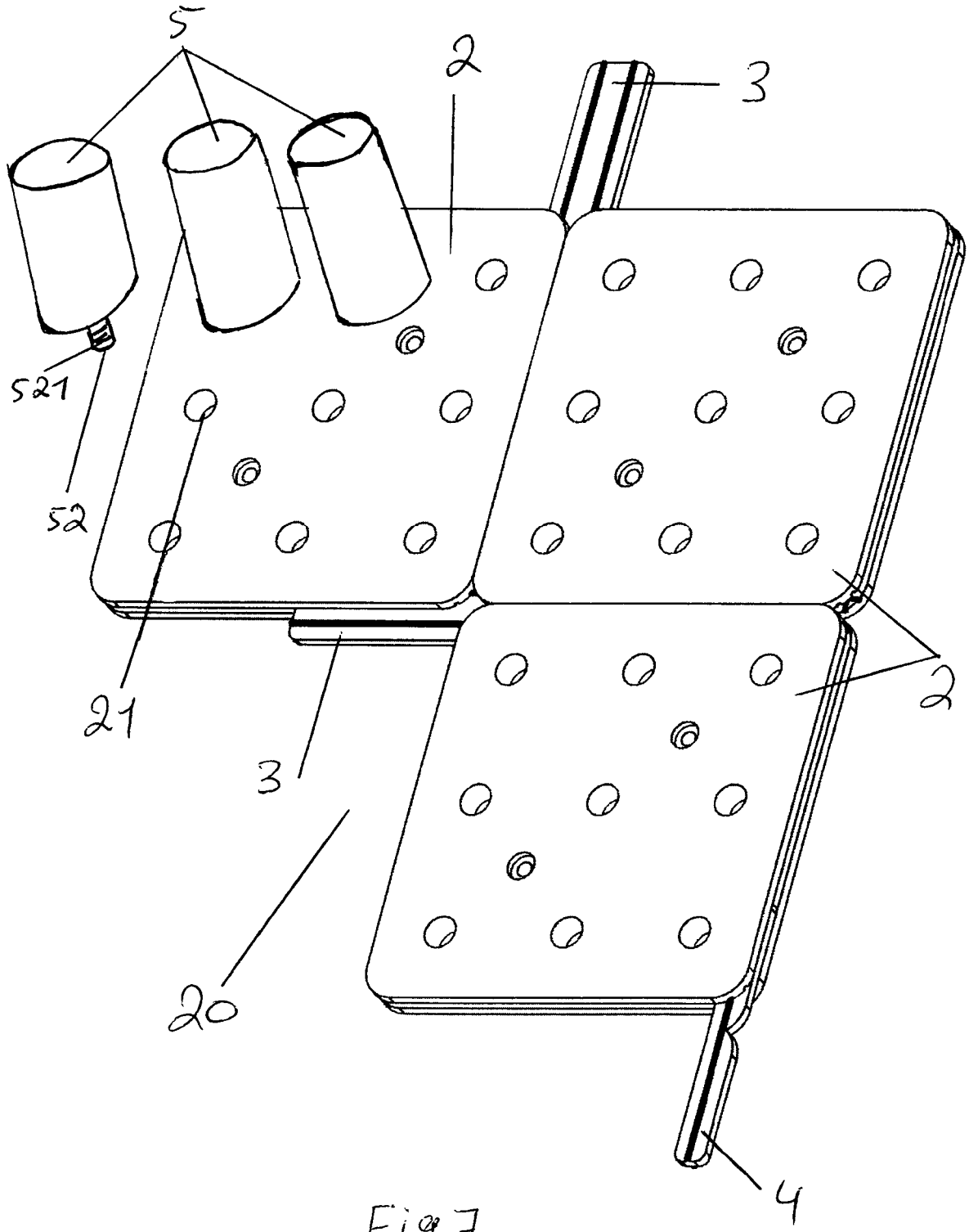

FIG. 7 discloses a layer made of 3 plates.

Figure 8:
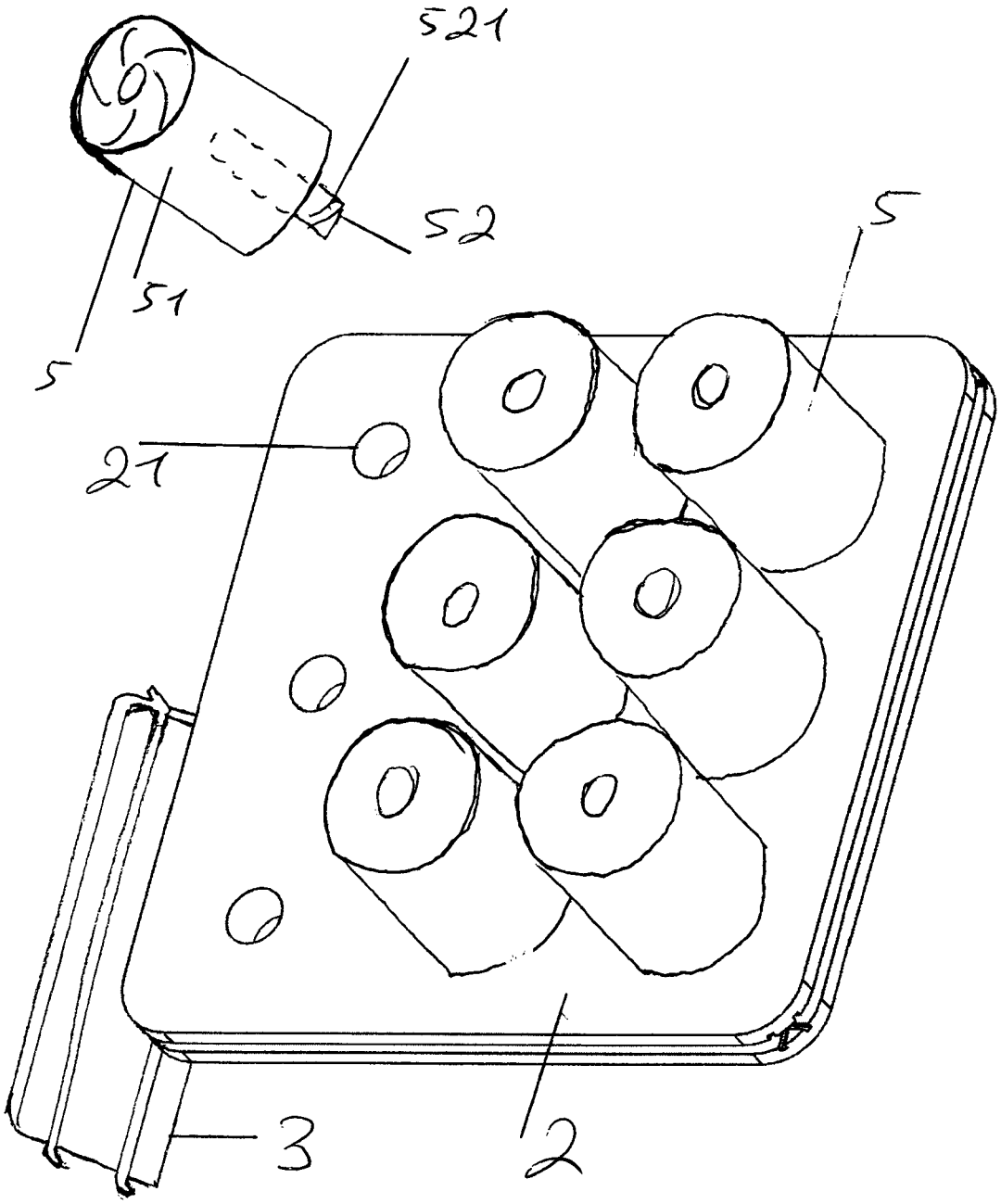

FIG. 8 shows rollers and plate of a module.

Figure 9:
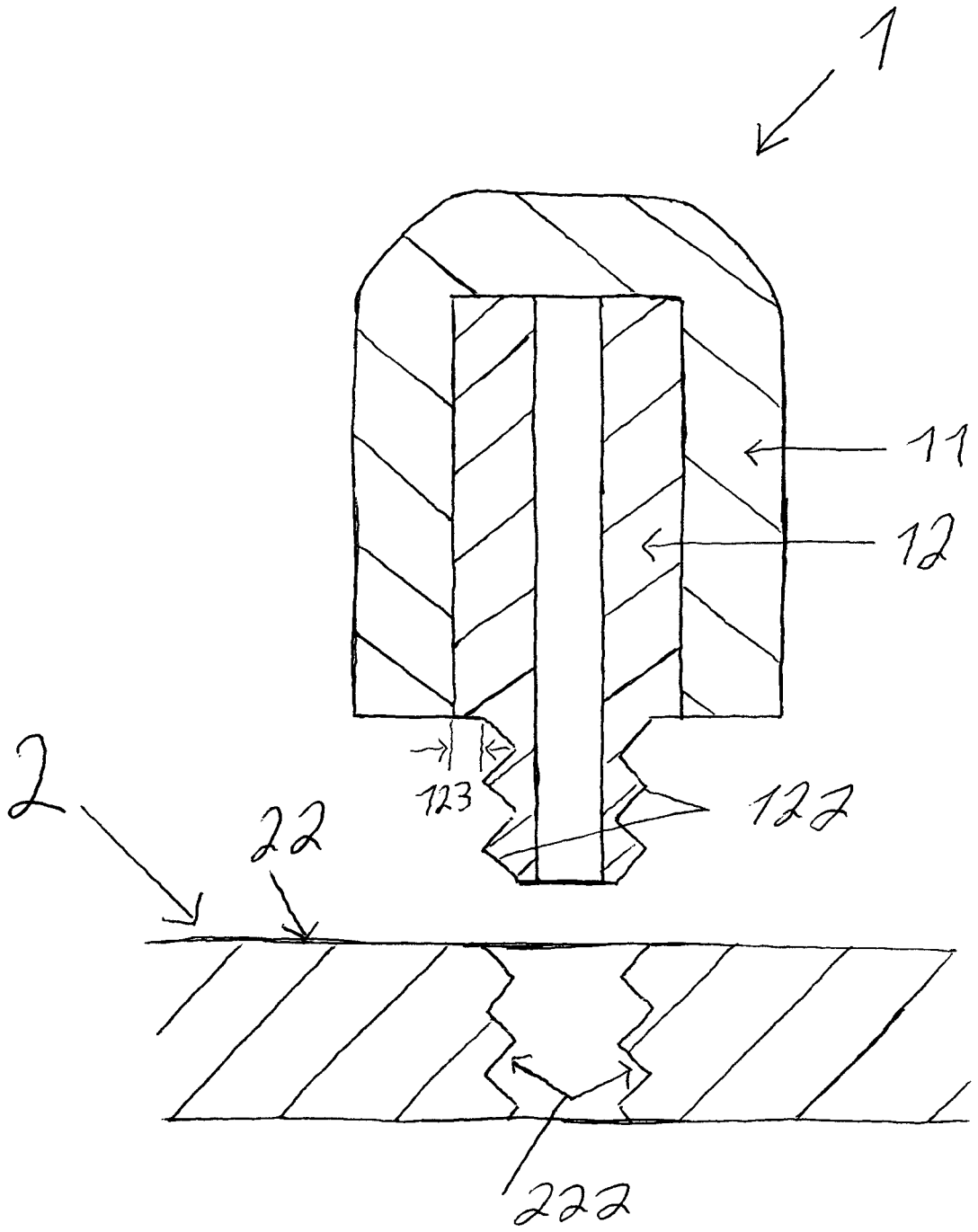

FIG. 9 shows the tube having external thread and stop in a section along the axis.

Figure 10:
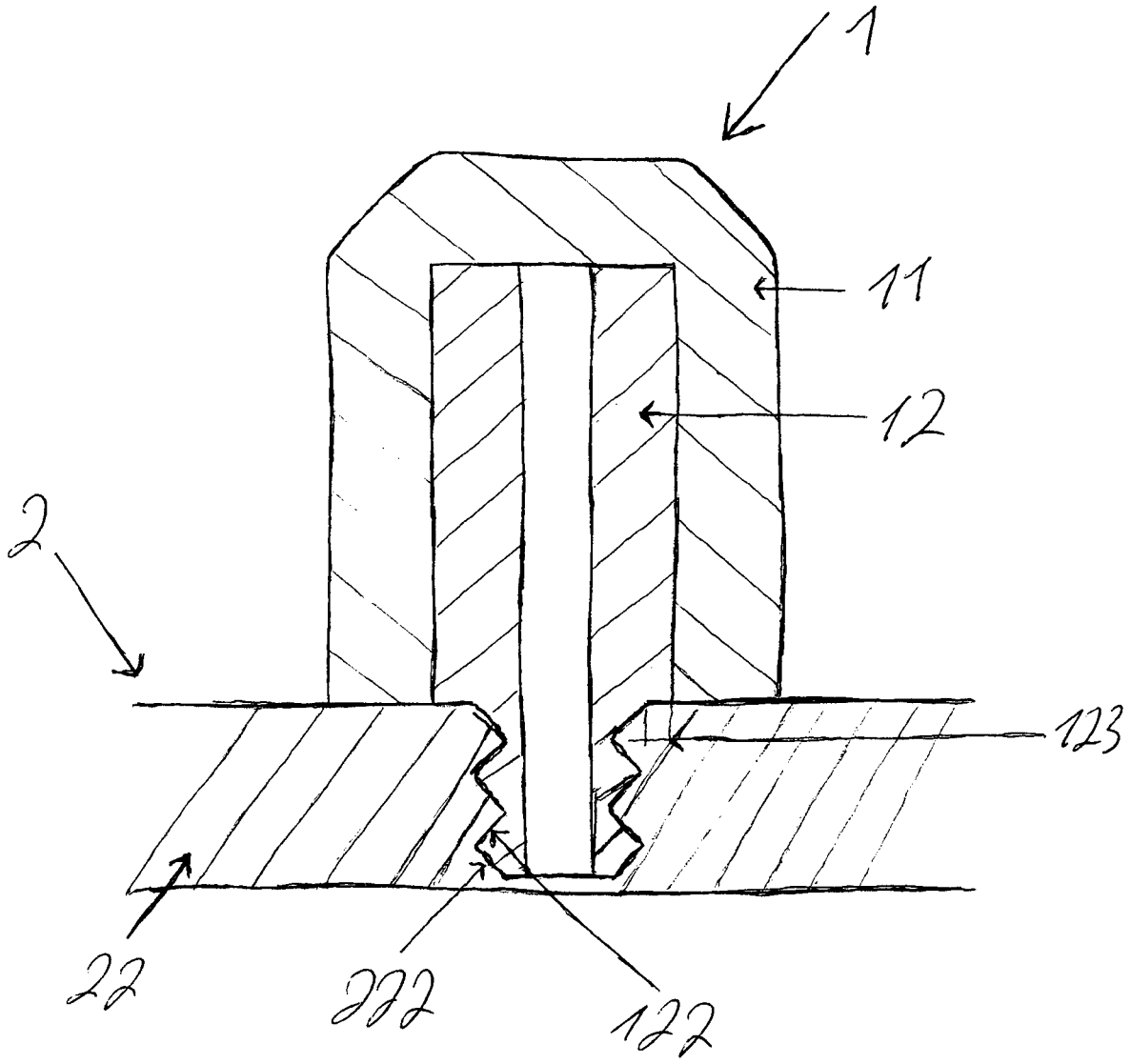

FIG. 10 shows a section through a locking of the carrier with a plate.

EXAMPLES

Figure 1:
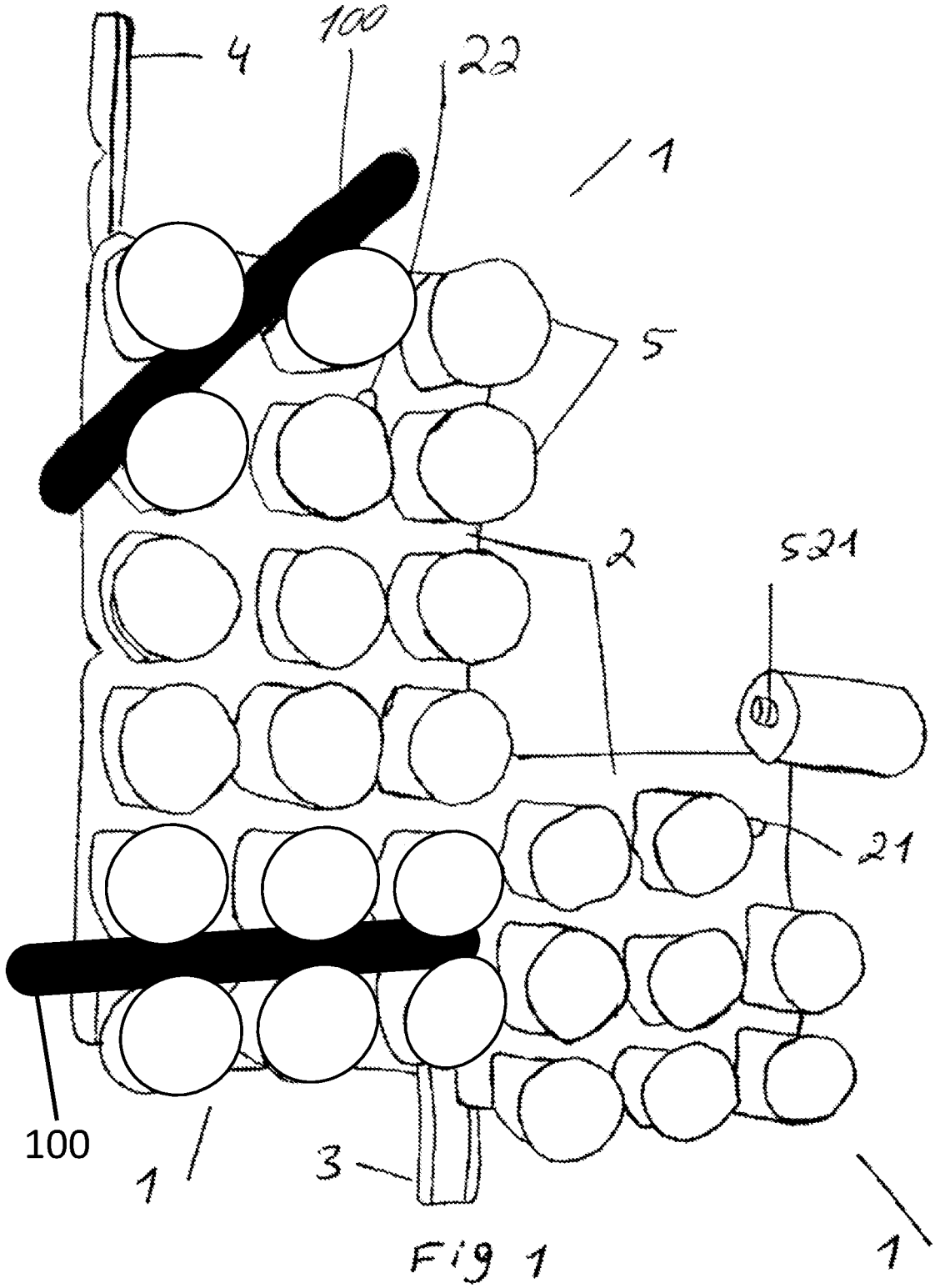
FIG. 1 shows three modules fastened with one another.
Figure 2:
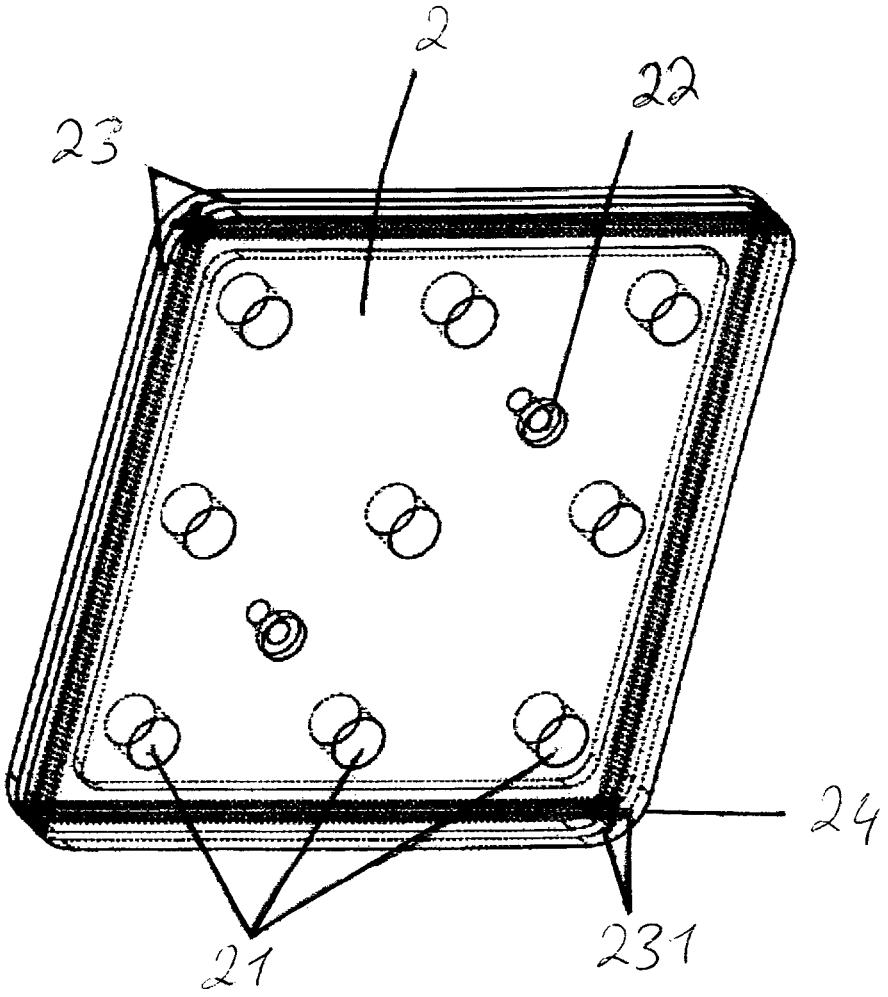
FIG. 2 shows a plate having nine threaded holes and two fastening holes.
Figure 3:
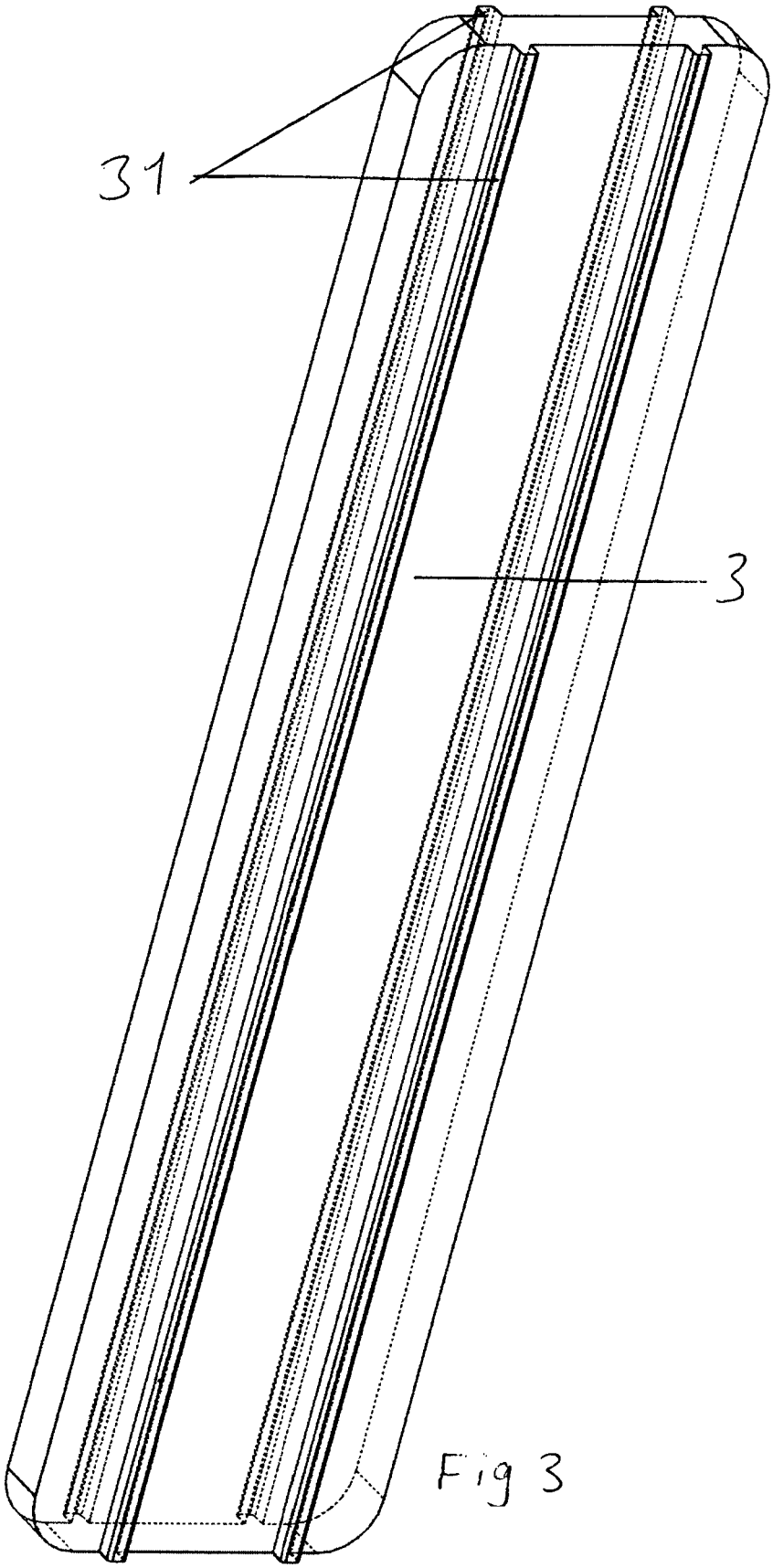
FIG. 3 shows connecting webs which are formed as tongues arranged in a mirror-image.
Figure 4:
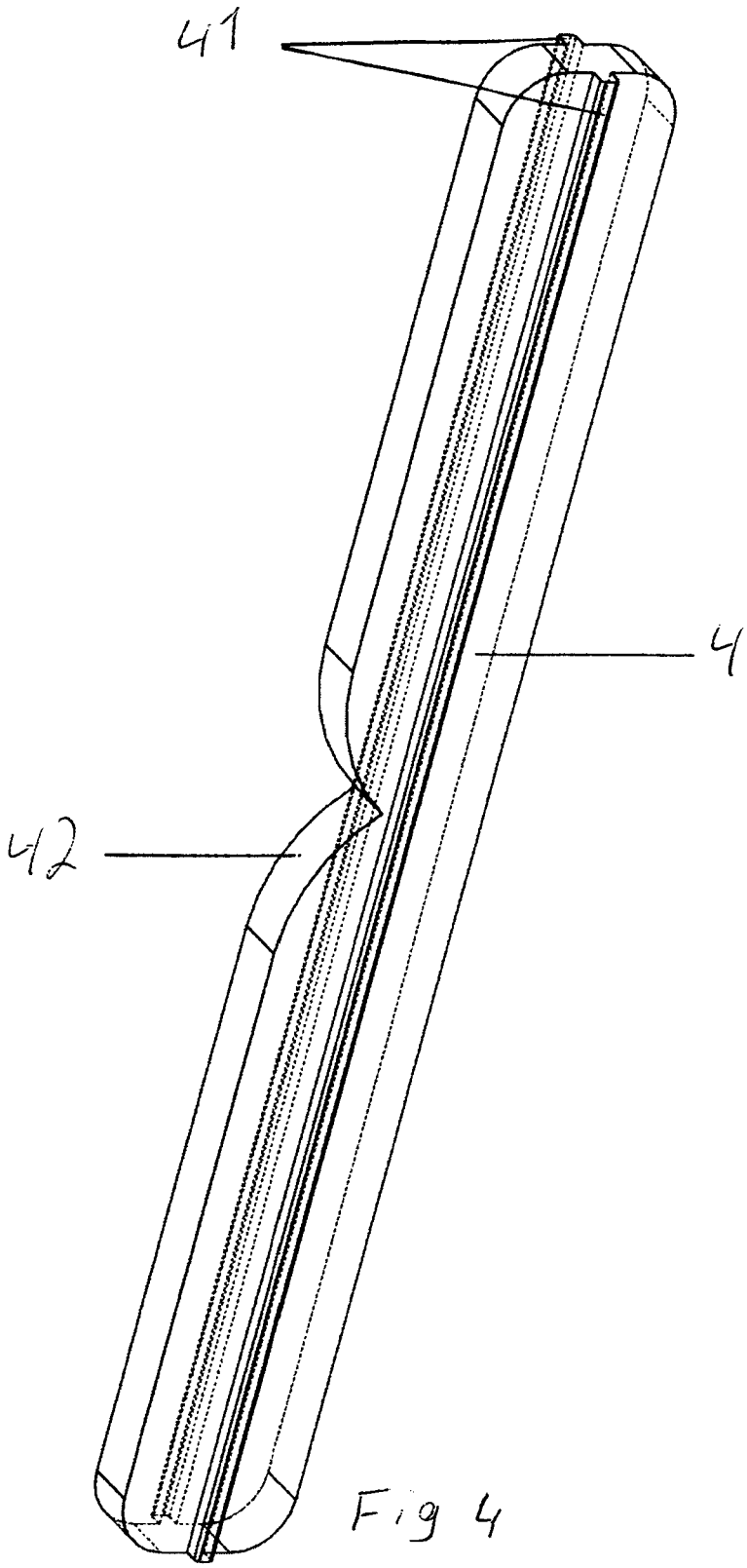
FIG. 4 shows a simplified tongue for locking on the edge.

1. A module 1 according to the invention as shown in FIG. 1 consists of a plate 2 according to FIG. 2 and nine rollers 5 screwed therein according to FIG. 5. Multiple modules 1 are fastened with one another using inner and outer connecting webs or bridges 3, 4 according to FIGS. 3 and 4 in that the connecting webs 3 according to FIG. 3 are inserted into grooves 23 of the plates 2. Small tongues 31 in small grooves 231 hold the modules 1 together so that they do not fall apart.

Figure 6:
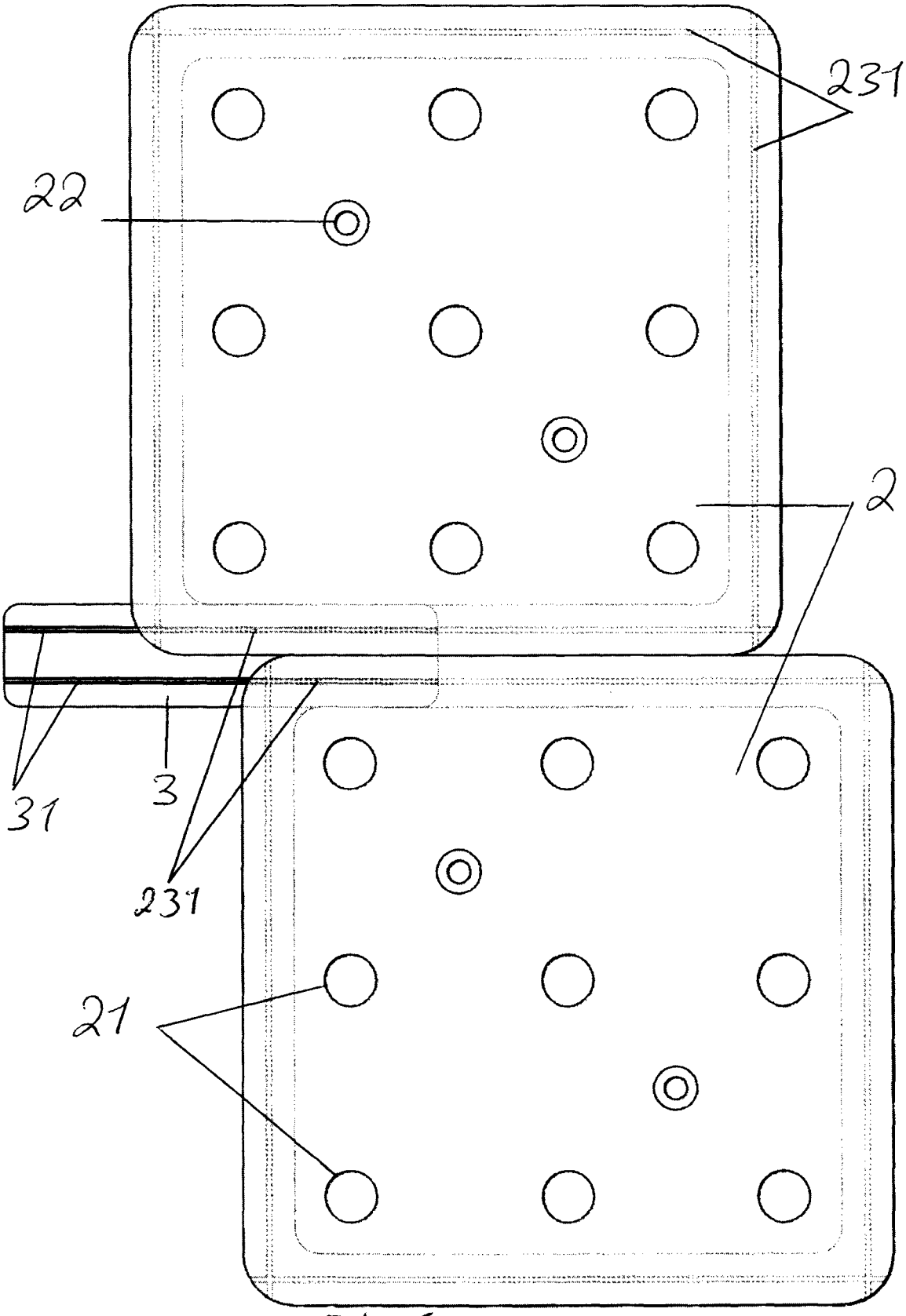
FIG. 6 shows the insertion of a double tongue to hold two plates on one another.

According to FIG. 3, the inner connecting webs 3 are formed as mirror-image double tongues to the grooves 23 of the plates 2. Small tongues 31 are located on both sides in pairs to hold each of the connecting webs 3 in the small grooves 231. Plates 2 and connecting webs 3 are therefore only displaceable on one another according to FIG. 6.

The inner connecting webs 3 are dimensioned so that they can be pushed as springs into the grooves 23 and 231 of two adjacent plates 2 to be connected to one another, specifically with a pair of small tongues 31 in a pair of grooves 231 each.

The outer connecting webs 4 are halves of the connecting webs 3 provided with notch 42. They are as wide as the groove 23. If one pushes a web 4 lengthwise through two plates 2, which are held together using an inner web 3, these plates are no longer displaceable. An additional notch 42 with respect to the rounded corners 24 of the plates 2 at half-length reduces the visibility of the locking tongues 4. If the notch 42 is pushed in the middle between the plates 2, the web 4 remains concealed from the groove 23 in accordance with the notch 42.

The outer connecting webs 4 are formed as tongues to the grooves 23 of the plates 2. Two small tongues 41 are arranged as a pair on both sides to hold the connecting webs 4 in the small grooves 231 of the plates 2. The pair of small tongues 41 is identically dimensioned as the two tongue pairs 31 of the webs 3.

The outer connecting webs 4 are dimensioned so that they can be pushed as tongues into the grooves 23 and 231 of two adjacent plates 2 to be connected, specifically with one pair of small tongues 41 in one pair of grooves 231 in each case.

Figure 5:
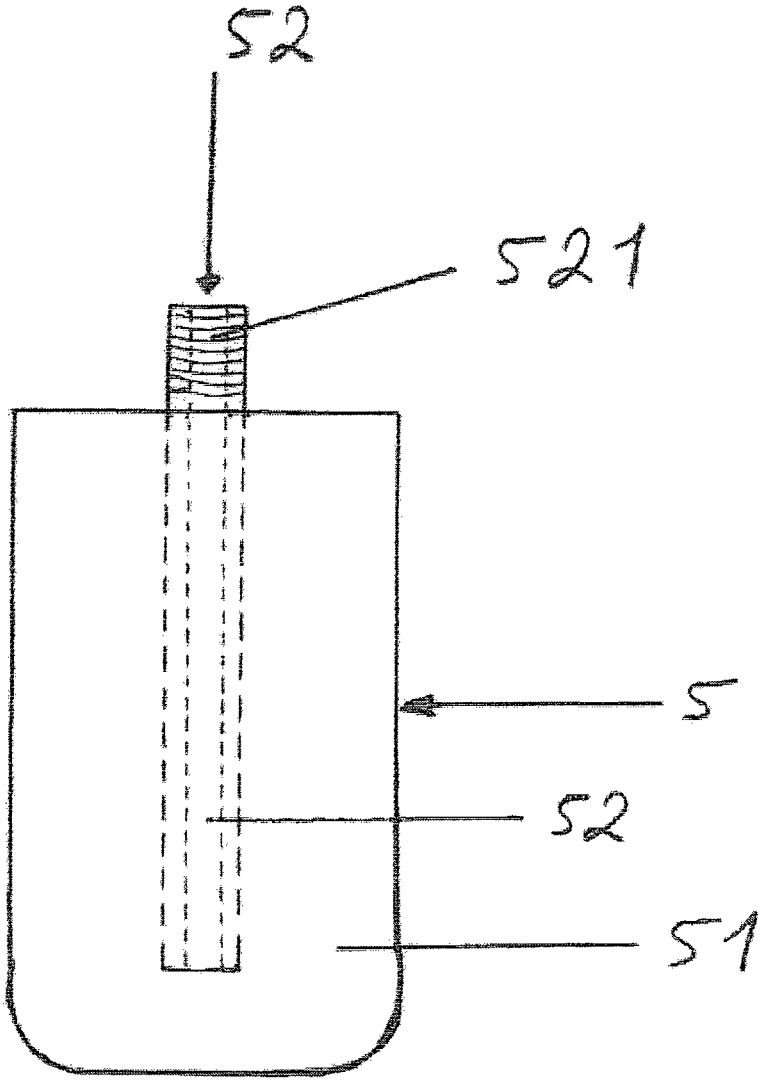
FIG. 5 shows a roller.

The rollers or composite bodies 5 according to FIG. 5 each consist of a rod or rigid carrier 52 and a sleeve or cap or sheath (such as a foam coating) 51 adhesively bonded on the rod or rigid carrier 52.

The rod 52 is formed as a bar or tube and has a thread 521 over the end not covered by the foam coating 51.

The rollers 5 are screwed with the thread 521 thereof into the threaded holes 21 provided for this purpose in the plates 2.

Objects 100, which are tidied in this manner, may be clamped or pushed between the rollers 5. The rollers 5 may also be unscrewed again to house larger objects. The threaded holes 21 are arranged regularly in relation to one another. Due to the adaptable equipping of the threaded holes 21 with rollers 5, this allows the option of providing space for greatly varying objects. FIG. 7 shows a layer 20 made of three plates 2, of which 2 are locked using connecting webs 3 and the third plate 2, which is still displaceable on the connecting web 3, is lockable using the outer connecting web 4. 2 rollers 5 are fastened in the layer 20. In the case of the third roller 5, the rod and having thread is visible, using which the roller 5 can be screwed into the threads of the holes 21 of the plates 2. FIG. 8 shows 6 rollers of a module protruding out of the plate, 3 holes for locking further rollers, and a roller showing its thread outside the plate. Grooves are visible laterally on the plate to lock plates with one another by means of tongues shown in FIGS. 3 and 4.

2. In contrast to Example 1, rollers 5 are produced from plastic tubes 52, screws, and foam coating 51, in that the foam coating 51 is adhesively bonded on the tubes 52. The rollers 5 are then screwed into the plates 2, in that the screws are firstly guided through the tubes 52.

3. In contrast to Example 1, rollers 5 are produced from plastic tubes 52, screws, and foam coating 51, in that screws are adhesively bonded in the plastic tubes 52 and the foam coating 51 is adhesively bonded on the plastic tubes 52. The rollers 5 are then screwed into the plates 2 using the screws fastened therein.

4. To produce modules according to the invention, threaded plates 2, double tongues 3, single tongues 4, and threaded rods 52 of the rollers 5 are produced via injection molding. For this purpose, the tongues 3 and 4 are to be designed matching with grooves 23. The small tongues 31, 41 are also designed matching with the small grooves 231. The small tongues 31, 41 and small grooves 231 hold the plates 2 and tongues 3, 4 so they are displaceable on one another, as long as the tongues 3 are only arranged in parallel to one another. The plates 2 may be locked on one another, in particular as a layer 20, using tongues 3, 4 arranged perpendicularly thereto. The threads 521 of the rods 52 are embodied matching with the threaded holes 21, so that the rods 52 can easily be screwed into and out of the threaded holes 21. A foam sleeve 51, which is cut and milled similarly to paint rollers from foam blocks, is adhesively bonded on each of the rods 52.

5. In contrast to the preceding example, to produce modules according to the invention, threaded plates 2, double tongues 3, single tongues 4, and threaded rods 52 of the rollers 5 are milled from wood, metal, in particular aluminum, or plastic, in particular Plexiglas.

6. Modules are assembled to form mats, in that the plates 2 having the tongues 3 are pushed against one another to interlock and the layers 20 formed in this case are locked using single tongues 4 at the edges. In this case, layers 20 having individually created patterns are produced. Rollers 5 are screwed using the threads 521 of the rods 52 into the holes 21 of the plates 2 in these patterns. The previously created patterns are further individualized using different colors of the rollers 5.

7. Makeup table or standing mirror

Modules according to one of Examples 1-3 or produced according to one of Examples 4 or 5 are adhesively bonded, in particular as a frame-shaped mat according to Example 6, to the mirror edge or its frame. For example, 5-10 cm squares as plates 2 each having nine 3-5 cm long and 2-3 cm thick rollers 5. The plates 2 are assembled using webs 3 to form tracks, in particular by inserting the connecting webs 3 between the plates 2. The plates are locked with one another by inserting connecting webs 4.

Lip gloss, mascara, eyeliner, comb, hairbrush, etc. are tidied in a frame assembled from modules according to the invention and arranged around the mirror, in particular rotating mirror. The frame may be expanded outward using additional modules.

8. Hand cream, foot cream, books, spectacles, hearing aid, contraceptives, sex toys, nail polish, beverage bottle, snacks, etc. are placed close at hand adjacent to the bed, for example, arranged above a nightstand, in particular using a mat according to the invention according to Example 6 screwed onto the wall through the holes 22.

9. A personal organizer according to one of Examples 1-3 or produced according to one of Examples 4 or 5 is adhesively bonded as a mat according to Example 6 on the entry doors in the foyer. For example, consisting of 10-15 cm squares as plates 2 each having nine 5-10 cm long and 3-5 cm thick rollers 5. Keys, mobile telephone, charger, gloves, and spectacles are typically inserted therein and larger objects can be held in roller spaces which are left open.

10. In the office, the objects otherwise held on the desktop are held well visible in a mat according to the invention on the wall above the desk, in particular mobile telephone, charger, beverage bottle, gloves, hole punch, stapler, pen, etc.

11. In the basement or the garage, tools, cleaners, vehicle and bicycle accessories, toys, etc. are held well visible in mats fastened on the wall.

12. In the bathroom, a mat adhesively bonded onto tiles using two-sided adhesive film is used to hold the washing, bathing, and showering, care and cleaning articles otherwise held on shelves, in particular shampoo, brushes, toothpaste, razor, lotion bottles and cans, comb, spray cans, and hairdryer.

13. In a kitchen, a cabinet wall is made into the holding surface for kitchen utensils, cleaners, or ingredients. For this purpose, threaded plates 2 are fastened using two-sided adhesive film on the wall and foam rollers are screwed into the threaded plates. Alternatively, the cabinet wall is formed as a threaded plate, into which the rollers are screwed.

14. In vehicles, modules made of 6×6 cm plates 2 are assembled to form patterns in order to hold objects for the crew in rockets and aircraft using the rollers 5 fastened therein, in passenger vehicles and trucks also to hold a smart phone on the dashboard for communication, in particular telephoning and navigating, on ships, trucks, and train cabins to use doors to hold objects for or during staying overnight.

15. A dashboard or console as a plate layer 20 or plate 2, and rollers 5 matching thereto, wherein holes 21 are in the dashboard or the console and the rollers 5 are lockable using rods 52 in the holes 21. Foam sleeves 51 fastened on the rods 52 are used for holding accessories, for example, navigation device, CD, USB stick, pen, charger, flatware; personal objects, for example, wallet, keys, smart phone; and provisions, for example, sweets, cigarettes. For this purpose, the utensils to be held are clamped between the rollers. For a better view of a navigation device or smart phone, the rollers obstructing the view of the display screen are detached from the dashboard or not fastened therein to begin with.

16. The contents of trouser pockets and jacket pockets can be held visible in all spaces of the above-described examples, so that the search for wallet, keys, mobile telephone, chewing gum, etc. is superfluous.

17. The composite material 1 contains 2 bodies connected to form a composite material. The greater part of an inner body 12 is enclosed by an outer body 11 and protrudes with a shorter part 121 therefrom. In this case, it penetrates the outer body 11 over a majority of its length. The outer body 11 is damping, in particular a damping cap or sleeve, preferably a foam sleeve. The inner body 12 is a carrier 12, in particular a rod which can be locked or screwed in, for example, a tube or a bar having a locking unit 121 protruding out of the sleeve 11. Carrier 12 and damper 11 are fastened, in particular adhesively bonded, with one another to form a composite. The carrier 12 protrudes with one end 121 out of the sleeve 11. This end 121 is designed for locking in a base, for example, for a click fitting, a bayonet fitting, or using a thread.

The main axis of rotation of the moment of inertia of the composite material 1 is preferably an axis of symmetry around which the sleeve 11 and the carrier 12 are aligned at least inside the sleeve. This axis of symmetry is the axis of the rough structures of the carrier, in particular rod, and the sleeve, in particular roller. The carrier contains a fine structure, in particular a clicking or locking structure, thread, or bayonet fitting portion for fastening in an opening, which can deviate from the symmetry.

Locking of the composite material 1 is performed in a base, which comprises openings formed in this regard, into which the carrier ends protruding out of the sleeve are locked, in particular latched, or screwed in.

If the composite material is used as a curler, the curls are curled as using known foam rollers. The hair may now additionally be treated by materials conducted in a precisely metered manner through the tubular carrier 12, for example, using hot air, dye, tint, bleach, care product, or shampoo. After usage, the curlers are washed, but then fastened according to the invention in the base for drying or storage. Upon the use thereof as shock absorbers, they are elastic with respect to small loads and they are easily replaceable after greater loads which destroy them. They are therefore ideal legs of devices, for example, record player, mobile telephone, monitor, or spacers for furniture.

18. FIG. 2 shows a section through 2 profiles connected to one another by material bonding and a plate having a threaded hole. The profiles are axially symmetrical except for the thread 122. The outer profile is the sleeve 11 and the inner profile is the carrier 12 formed as a tube. The carrier 12 comprises a stop surface 123, to be pressed using this against the surface 22 of the plate 2 upon tightening of the thread 122 in the internal thread 222, in order to lock the composite material 1 in a formfitting manner on the plate 2 in this manner.

FIG. 3 shows the friction lock of the profiles connected to one another in a materially bonded manner with the plate 2. The contact pressure generated upon tightening locks the carrier with the plate. It requires a jerk for loosening.

Without such a jerk, the carrier has no play to wobble. The carrier could fall out of the plate due to wobbling.

This locking with the composite material 1 is established in that 2 profiles are connected by means of material bonding to form the composite material 1, wherein a damping sleeve 11 is arranged around the carrier 12, so that the carrier 12 protrudes out of the sleeve 11 in the region of the locking and the carrier 12 is guided using the part protruding out of the sleeve 11 in the hole of the plate 2, and at this hole, the carrier 12 is pressed with its stop surface 123 against the surface 22 upon tightening of the composite material 1.

19. Instead of a friction-locked locking as according to FIG. 3, an alternative screw fitting is formfitting, in particular a bayonet fitting. A further suitable form fit is a click fitting.

A form fit or friction lock of a plate 2 and a carrier 12 is thus provided, in which the carrier 12 is held in a hole in the plate 2. According to the invention, in this case the carrier 12 is enclosed in a materially bonded manner by a damping sleeve 11 except for the part 121 protruding into the hole or the part protruding out of the sleeve 11 for locking.

20. To produce the composite material 1 from a foam sleeve 11 and a rod 12, in particular tube, a rod 12 is produced in injection molding having a thread 122, which ends at a stop 123. The rod 12 is adhesively bonded according to the invention up to the stop in the foam sleeve 11, out of which the thread 122 then protrudes.

The composite material is suitable for cleaning hollow bodies, corners, attachments, and cabinet surfaces. For cleaning the composite material, it is preferably made washing-machine-safe or the carrier is formed as a tube. If the carrier of the composite material is formed as a tube, the composite material is suitable as a filter. Such filters are suitable for application and metering of liquids, in particular cleaners, care products, or coloring agents, for example, for treating hair.

LIST OF REFERENCE SIGNS

1 module
2 plate
20 plate layer
21 threaded holes
22 fastening holes
23 large groove
231 small groove
24 rounded corners
3 inner connecting web as double tongue
31 small tongue
4 outer connecting web as single tongue
41 small tongue
42 notch
5 roller
51 foam sleeve
52 rod
521 thread

What is claimed is:

1. An apparatus for holding at least one object, the apparatus comprising:

at least one plate having a plurality of holes;

a plurality of composite bodies, each composite body comprising:

a rigid carrier having an end configured to be removably lockable to any one of the holes via cooperation with any one the holes; and a sheath fixedly fastened to the carrier and radially surrounding the carrier, such that the end of the carrier protrudes longitudinally from the sheath;

wherein:

the carrier comprises a first rigid material;

the sheath comprises a second material different from the first material and comprising at least one of: an elastic material, a damping material, and foam;

the composite bodies are configured to be removably lockable to the plate and to hold the object compressed between the sheaths of the composite bodies.

2. The apparatus of claim 1, wherein the carrier and the sheath are materially bonded together.

3. The apparatus of claim 1, wherein the sheath is covered by a textile coating.

4. The apparatus of claim 1, wherein the end of the carrier forms 10 to 50% of a length of the carrier.

5. The apparatus of claim 1, wherein the at least one plate comprises a plurality of plates, detachably joined to each other to form a planar plate layer.

6. The apparatus of claim 5, wherein:

each plate has at least one side groove extending along a side of the plate and inward from the side of the plate;

two small grooves extend from each side groove perpendicularly to the side groove, each small groove extending toward a respective planar surface of the plate, the small grooves extending longitudinally parallel to the side groove and to the side of the plate;

the apparatus comprises at least one connecting bridge formed as a planar sheet and having two tongues, each extending perpendicularly to opposing planes of the sheet and longitudinally parallel to a longitudinal dimension of the sheet;

the connecting bridge is configured to be inserted in a first plate such that a first portion of the sheet enters the side groove of the first plate and first portions of the tongues enter the second grooves of the first plate, and the connecting bridges is configured to be inserted in a second plate such that a second portion of the sheet enters the side groove of the second plate and second portions of the small tongues enter the second grooves of the second plate, thereby connecting the first plate to the second plate.

7. The apparatus of claim 5, wherein:

each plate has at least one side groove extending along a side of the plate and inward from the side of the plate;

two second grooves extend from each side groove perpendicularly to the side groove, each second groove extending toward a respective planar surface of the plate, the second grooves extending longitudinally parallel to the side groove and to the side of the plate;

the apparatus comprises at least one connecting bridge formed as a planar sheet and having a first pair and a second pair of tongues, the first pair having a first tongue extending perpendicularly from a first plane of the sheet and a second tongue extending perpendicularly from a second plane of the sheet opposite the first plane, the second pair having a third tongue extending perpendicularly from the first plane of the sheet and a fourth tongue extending perpendicularly from the second plane of the sheet opposite the first plane, both pairs extending longitudinally parallel to a longitudinal dimension of the sheet;

the connecting bridge is configured to be inserted in a first plate such that a portion of the sheet enters the side groove of the first plate and at least a portion of the first pair of the tongues enters the second grooves of the first plate, and the connecting bridge is configured to be inserted in a second plate such that a portion of the sheet enters the side groove of the second plate and at least a portion of the second pair of tongues enters the second grooves of the second plate, thereby connecting the first plate to the second plate.

8. The apparatus of claim 1, wherein the carrier has a shape of a rod.

9. The apparatus of claim 1, wherein the carrier and the at least one plate are molded by means of injection molding.

10. The apparatus of claim 1, wherein the at least one plate comprises at least one second hole configured for being traversed by securing means to secure the at least one plate to a surface.

11. A method for holding an object, the method comprising:

providing at least one plate having a plurality of holes;

providing a plurality of composite bodies configured to be removably lockable to the plate, each composite body comprising:

a rigid carrier having an end configured to be removably lockable to any one of the holes via cooperation with any one of the holes, the rigid carrier comprising a first rigid material; and a sheath fixedly fastened to the carrier and radially surrounding the carrier, such that the end of the carrier protrudes longitudinally from the sheath, the sheath comprising a second material different from the first material and comprising at least one of: an elastic material, a of damping material, and foam;

locking at least two composite bodies to the plate by locking respective rigid carriers to respective holes in the plate;

placing the object between the at least two composite bodies such that the object is compressed between the sheaths of the composite bodies.

12. The method of claim 11, comprising:

detachably joining a plurality of plates together to form a planar plater layer.

13. The method of claim 12, comprising:

providing each plate with at least one side groove extending along a side of the plate and inward from the side of the plate;

providing two second grooves extending from each side groove perpendicularly to the side groove, each second groove extending toward a respective planar surface of the plate, the second grooves extending longitudinally parallel to the side groove and to the side of the plate;

wherein detachably joining the plurality of plates together to form the planar plater layer comprises:

providing at least one connecting bridge formed as a planar sheet and having two tongues, each extending perpendicularly to opposing planes of the sheet and longitudinally parallel to a longitudinal dimension of the sheet;

inserting the connecting bridge in a first plate such that a first portion of the sheet enters the side groove of the first plate and first portions of the tongues enter the second grooves of the first plate; and inserting the connecting bridge in a second plate such that a second portion of the sheet enters the side groove of the second plate and second portions of the tongues enter the second grooves of the second plate, thereby connecting the first plate to the second plate.

14. The method of claim 12, comprising:

providing each plate has with at least one side groove extending along a side of the plate and inward from the side of the plate;

providing a two second grooves extending from each side groove perpendicularly to the side groove, each second groove extending toward a respective planar surface of the plate, the second grooves extending longitudinally parallel to the side groove and to the side of the plate;

wherein detachably joining the plurality of plates together to form the planar plater layer comprises:

providing at least one connecting bridge formed as a planar sheet and having a first pair and a second pair of tongues, the first pair having a first tongue extending perpendicularly from a first plane of the sheet and a second tongue extending perpendicularly from a second plane of the sheet opposite the first plane, the second pair having a third tongue extending perpendicularly from the first plane of the sheet and a fourth tongue extending perpendicularly from the second plane of the sheet opposite the first plane, both pairs extending longitudinally parallel to a longitudinal dimension of the sheet;

inserting the connecting bridge in a first plate such that a portion of the sheet enters the side groove of the first plate and at least a portion of the first pair of the tongues enters the second grooves of the first plate; and inserting the connecting in a second plate such that a portion of the sheet enters the side groove of the second plate and at least a portion of the second pair of tongues enters the second grooves of the second plate, thereby connecting the first plate to the second plate.

15. A method for manufacturing an apparatus for holding at least one object, the method comprising:

manufacturing at least one plate having a plurality of holes by means of injection molding;

manufacturing a plurality of composite bodies, each composite body comprising:

a rigid carrier having an end configured to be removably lockable to any one of the holes via cooperation with any one of the holes; and a sheath fixedly fastened to the carrier and radially surrounding the carrier, such that the end of the carrier protrudes longitudinally from the sheath;

wherein:

the carrier comprises a first rigid material molded by injection molding;

the sheath comprises a second material different from the first material and comprising at least one of: an elastic material, a damping material, and foam;

the composite bodies are configured to be removably lockable to the plate and to hold the object compressed between the sheaths of the composite bodies.

16. The method of claim 15 further comprising:

manufacturing at least one connection bridge via injection molding.

17. The method of claim 16, wherein:

each plate has at least one side groove extending along a side of the plate and inward from the side of the plate;

two second grooves extend from each side groove perpendicularly to the side groove, each second groove extending toward a respective planar surface of the plate, the second grooves extending longitudinally parallel to the side groove and to the side of the plate;

the at least one connecting bridge is formed as a planar sheet and having two tongues, each extending perpendicularly to opposing planes of the sheet and longitudinally parallel to a longitudinal dimension of the sheet;

the connecting bridge is configured to be inserted in a first plate such that a first portion of the sheet enters the side groove of the first plate and first portions of the tongues enter the second grooves of the first plate, and the connecting bridges is configured to be inserted in a second plate such that a second portion of the sheet enters the side groove of the second plate and second portions of the tongues enter the second grooves of the second plate, thereby connecting the first plate to the second plate.

18. The method of claim 16, wherein:

each plate has at least one side groove extending along a side of the plate and inward from the side of the plate;

two second grooves extend from each side groove perpendicularly to the side groove, each second groove extending toward a respective planar surface of the plate, the second grooves extending longitudinally parallel to the side groove and to the side of the plate;

the at least one connecting bridge is formed as a planar sheet and having a first pair and a second pair of tongues, the first pair having a first tongue extending perpendicularly from a first plane of the sheet and a second tongue extending perpendicularly from a second plane of the sheet opposite the first plane, the second pair having a third tongue extending perpendicularly from the first plane of the sheet and a fourth tongue extending perpendicularly from the second plane of the sheet opposite the first plane, both pairs extending longitudinally parallel to a longitudinal dimension of the sheet;

the connecting bridge is configured to be inserted in a first plate such that a portion of the sheet enters the side groove of the first plate and at least a portion of the first pair of the tongues enters the second grooves of the first plate, and the connecting bridge is configured to be inserted in a second plate such that a portion of the sheet enters the side groove of the second plate and at least a portion of the second pair of tongues enters the second grooves of the second plate, thereby connecting the first plate to the second plate.

19. A plate having a plurality of holes, each hole being configured to receive and be removably lockable with an end of a carrier of a composite body;

wherein:

the plate has at least one side groove extending along a side of the plate and inward from the side of the plate;

two second grooves extend from each side groove perpendicularly to the side groove, each second groove extending toward a respective planar surface of the plate, the second grooves extending longitudinally parallel to the side groove and to the side of the plate;

a connecting bridge separate from the plate is formed as a planar sheet and having two tongues, each extending perpendicularly to opposing planes of the sheet and longitudinally parallel to a longitudinal dimension of the sheet;

the connecting bridge is configured to be inserted in a first plate such that a first portion of the sheet enters the side groove of the first plate and first portions of the tongues enter the second grooves of the first plate, and the connecting bridges is configured to be inserted in a second plate such that a second portion of the sheet enters the side groove of the second plate and second portions of the tongues enter the second grooves of the second plate, thereby connecting the first plate to the second plate;

a plurality of the plates are joinable to each other via respective connecting bridges to form a planar plate layer.

20. A plate having a plurality of holes, each hole being configured to receive and be removably lockable with an end of a composite body;

wherein:

the plate has at least one side groove extending along a side of the plate and inward from the side of the plate;

two second grooves extend from each side groove perpendicularly to the side groove, each second groove extending toward a respective planar surface of the plate, the second grooves extending longitudinally parallel to the side groove and to the side of the plate a connecting bridge separate from the plate is formed as a planar sheet and having a first pair and a second pair of tongues, the first pair having a first tongue extending perpendicularly from a first plane of the sheet and a second tongue extending perpendicularly from a second plane of the sheet opposite the first plane, the second pair having a third tongue extending perpendicularly from the first plane of the sheet and a fourth tongue extending perpendicularly from the second plane of the sheet opposite the first plane, both pairs extending longitudinally parallel to a longitudinal dimension of the sheet;

the connecting bridge is configured to be inserted in a first plate such that a portion of the sheet enters the side groove of the first plate and at least a portion of the first pair of the tongues enters the second grooves of the first plate, and the connecting bridge is configured to be inserted in a second plate such that a portion of the sheet enters the side groove of the second plate and at least a portion of the second pair of tongues enters the second grooves of the second plate, thereby connecting the first plate to the second plate;

a plurality of the plates are joinable to each other via respective connecting bridges to form a planar plate layer.

* * * * *